US005396273A

United States Patent [19]

Stamer

[11] Patent Number: 5,396,273

[45] Date of Patent: Mar. 7, 1995

[54] AUTOMATIC CHARACTER HEIGHT CONTROL FOR INK JET PRINTERS

[75] Inventor: Michael E. Stamer, Lincolnwood, Ill.

[73] Assignee: Videojet Systems International, Inc., Niles, Ill.

[21] Appl. No.: 827,896

[22] Filed: Jan. 30, 1992

Related U.S. Application Data

[63] Continuation of Ser. No. 599,644, Oct. 18, 1990, abandoned.

[51] Int. Cl.[6] ..... B41J 2/12

[52] U.S. Cl. ..... 347/78; 347/74; 347/76; 347/79; 347/80

[58] Field of Search ..... 347/73, 74, 75, 76, 347/77, 78, 79, 80, 81, 82

[56] References Cited

U.S. PATENT DOCUMENTS

| | | | |
|---|---|---|---|
| 4,015,267 | 3/1977 | Kasubuchi et al. | 347/79 |
| 4,384,295 | 5/1983 | Lewis et al. | 347/77 |
| 4,542,385 | 9/1985 | Jinnai et al. | 346/75 |
| 4,555,712 | 11/1985 | Arway et al. | 346/75 |
| 4,562,442 | 12/1985 | Jinnai et al. | 346/75 |
| 4,797,688 | 1/1989 | Furukawa | 347/78 X |
| 4,827,280 | 5/1989 | Stamer et al. | 346/1.1 |
| 4,847,631 | 7/1989 | Naruse et al. | 346/75 |

*Primary Examiner*—A. T. Grimley
*Assistant Examiner*—Sandra L. Brase
*Attorney, Agent, or Firm*—Rockey, Rifkin and Ryther

[57] ABSTRACT

A microprocessor-based control system for use in ink jet printers periodically measures flow rate of marking fluid, flow time or flight time of marking fluid drops and adjusts the voltage supplied to deflection electrodes-to maintain constant character height notwithstanding changes in the printer operating environment that would otherwise result in undesirable variation in character height. An alternate embodiment uses the flow time, flow rate or flight time information to adjust the charge amplifier gain, rather than the deflection voltage, to achieve the same result.

22 Claims, 3 Drawing Sheets

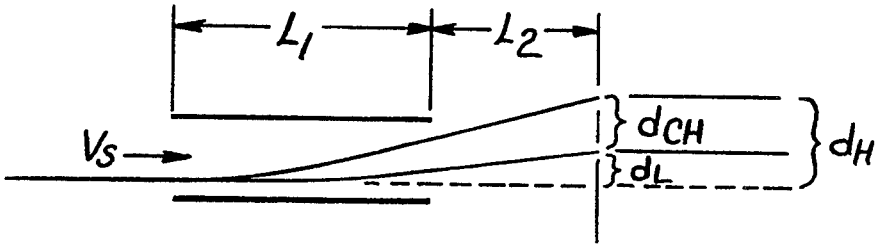
FIG.2B
FIG.4
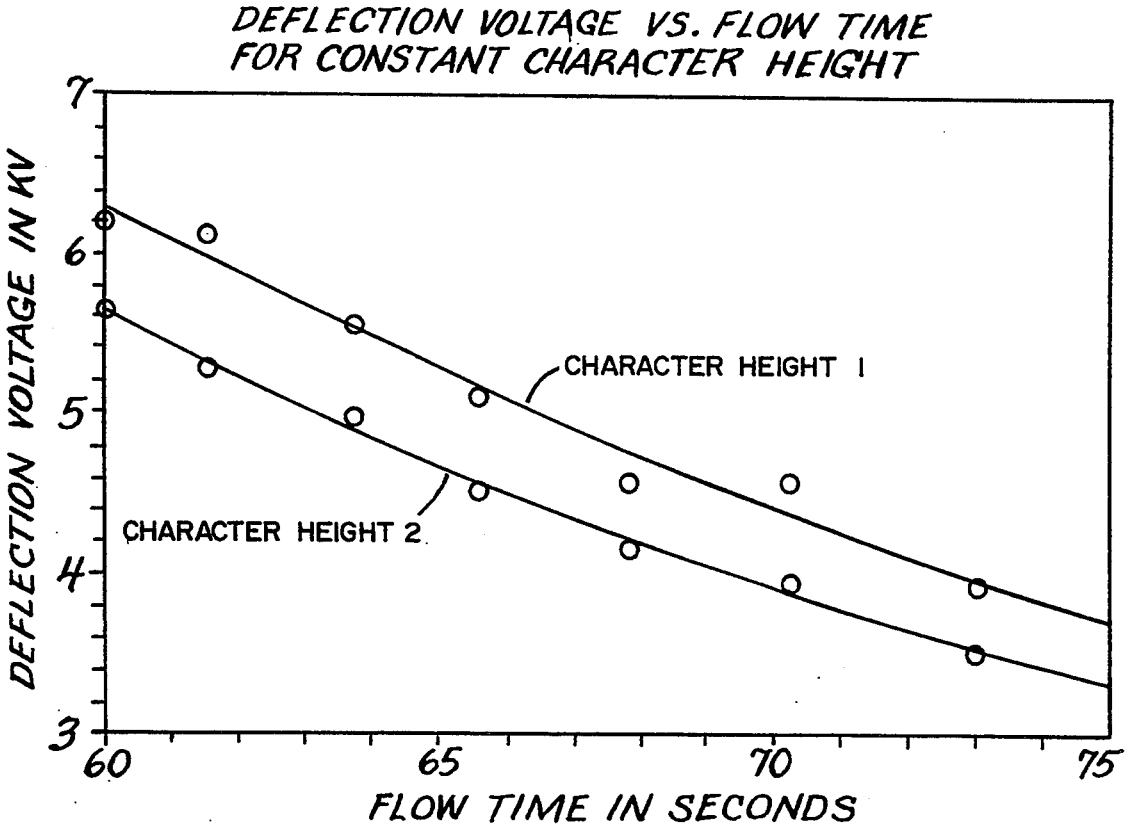

AUTOMATIC CHARACTER HEIGHT CONTROL FOR INK JET PRINTERS

This is a continuation of application Ser. No 07/599,644 filed on Oct. 18, 1990 now abandoned

BACKGROUND OF THE INVENTION

The present invention relates generally to the field of drop marking, including ink jet printing, and more particularly to a device to control the height of characters produced thereby.

The present invention may be applied to charge deflection printers of a type known in the art. Such printers employ a piezoelectric element to break a constant stream of marking fluid, such as ink, into uniform drops. The drops are then electrically charged by charging electrodes. The charged drops travel through an electric field created by deflection electrodes. The influence of the deflection field on the drops alters their flight path.

Most drop marking devices employ a pressurized distribution system for conveying marking fluid from a supply cheer to the nozzle and a collection reservoir to capture drops not intended to mark a target. The operation of most drop marking devices is controlled by a system microprocessor.

Use of a control system to maintain a constant ink flow rate in ink jet systems is known in the art. Examples of such systems are shown in U.S. Pat. No. 4,555,712 ("the Arway patent") and U.S. Pat. No. 4,827,280 ("the Stamer patent"). These control systems measure the flow rate of the marking fluid in the system and alter variables such as the amount of solvent contained in the ink, the magnitude of pressure applied to force ink through the system or ink temperature to keep the flow rate at a predetermined value.

Even with these control systems, a problem has been the inability to accurately control the height of printed characters. Height of printed characters has been found to vary due to a number of environmental factors, such as operating temperature of the printer and ink solvent evaporation. The prior art control systems lack the ability to fully compensate for variations in character height resulting from these factors.

Some attempts have been made to maintain constant character height for charge deflection printers by making adjustments when the printer is initially set up or during maintenance. One such scheme is disclosed in U.S. Pat. No. 4,847,631 ("the Naruse patent"). There, a user sets a predetermined character height when the print head is replaced. The Naruse patent discloses a relationship between the stream velocity of marking fluid and character height. Naruse, however, does not compensate for changes in character height over time due to the external factors previously described, principally changes in operating temperature.

A marking device capable of monitoring and adjusting the character height on an ongoing basis is desirable as it enhances marking quality.

Accordingly, it is an object of the present invention to provide a control system capable of automatically adjusting the character height for use with drop markers such as ink jet printers.

It is a further object of the invention to provide such a control system which has the capability of minimizing the influence on character height of external factors such as variations in printer operating temperature.

It is still another object of invention to provide such a control system capable of operation without regard to physical characteristics of the marking fluid used in the marking device.

It is an additional object of the invention to provide such a control system that is durable in construction, efficient in operation, and inexpensive to implement.

These objects, as well as others, will become apparent to those skilled in the art from the detailed description of the invention provided below.

SUMMARY OF THE INVENTION

The control system of the present invention dynamically adjusts the deflection sensitivity in ink jet marking devices. It exploits the relationship between the voltage applied to the deflection electrodes of a marking device and the height of the characters produced. The deflection voltage is periodically adjusted based on measured changes in marking fluid flow rate or flight time of drops of marking fluid to a print substrate.

In an alternate embodiment, the charge amplifier may be scaled (rather than adjusting the deflection voltage) to control character height.

Unlike character height control systems found in the prior art, such as the Naruse patent, the present invention determines stream velocity and/or flight time and periodically alters the deflection voltage or charge amplifier gain during printer operation. Thus, character height is kept within optimum limits notwithstanding changes in the printer operating environment that would otherwise adversely affect uniformity of character height.

BRIEF DESCRIPTION OF THE DRAWINGS

FIG. 2B is a diagram similar to FIG. 2A showing the most and least significantly deflected drops for forming a given character.

FIG. 4 is a graph showing the empirically determined relationship between deflection voltage and flow time for achieving constant character height.

DETAILED DESCRIPTION OF A PREFERRED EMBODIMENT

Figure 1:
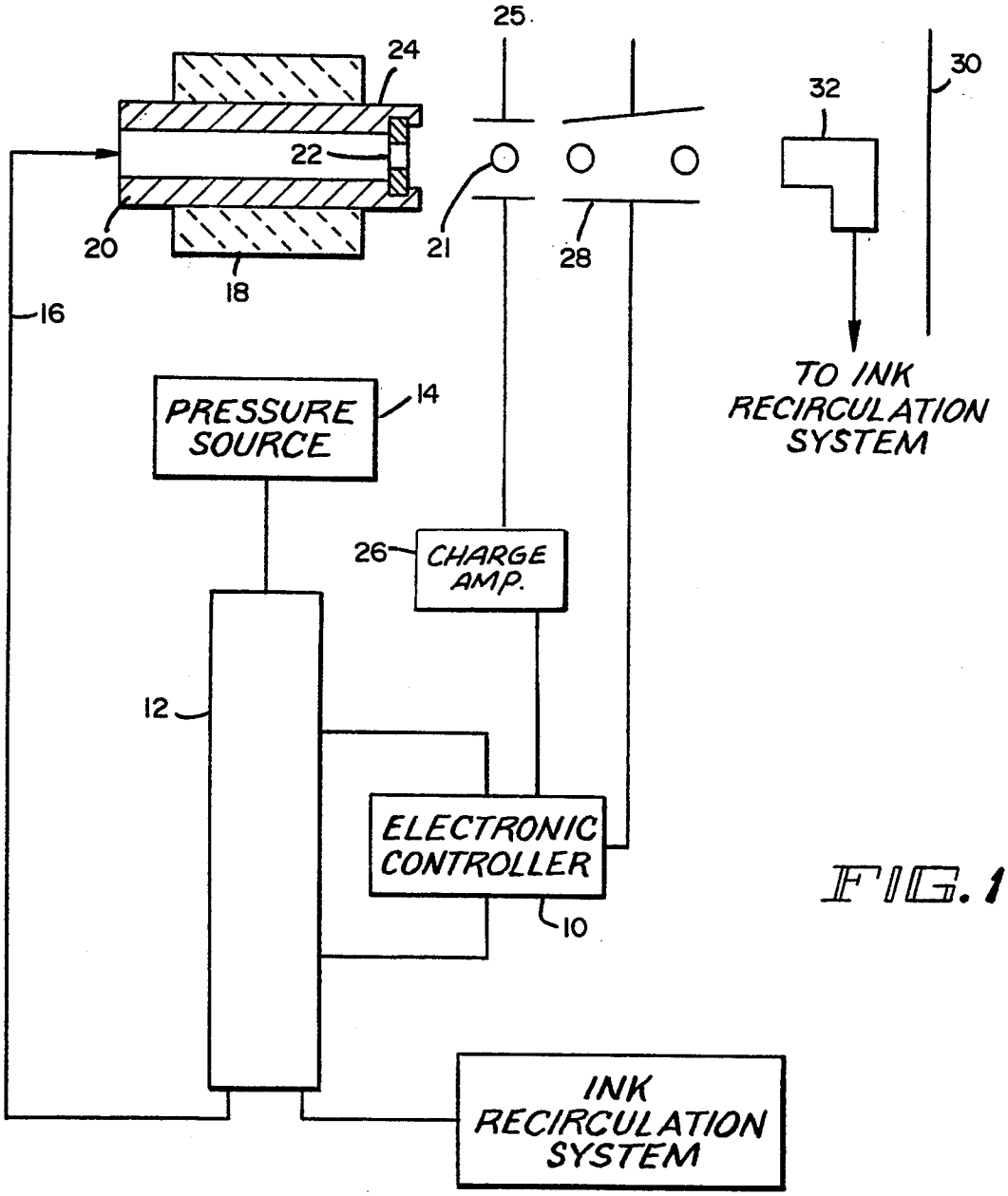
FIG. 1 is a schematic diagram of an ink jet printer suitable for use with the present invention.

Referring to the drawings, FIG. 1 shows a schematic of an ink jet printer suitable for use with the control system of the present invention. A system microprocessor is configured to measure the flow rate or flow time of ink through an ink chamber 12. As will be apparent to one having ordinary skill in the art, flow rate and flow time are inversely proportional to one another Thus, either may be calculated if the other is known, provided the volume of chamber 12 is also known. The teachings of the present invention may be practiced by measuring flow time, flow rate or flight time. For convenience these three parameters may be referred to collectively as "measured parameters." As will be described hereinafter, any one of the measured parameters may be used to set constant character height by adjusting the voltage on a set of deflection electrodes 28 or the gain of a charge amplifier 26. Charge amplifier gain and deflection voltage may be collectively referred to as the "adjusted parameters."

One method of measuring flow rate is disclosed in the Arway patent; however, the measured parameters may be determined by any suitable method. Ink is forced through the system by a pressure source 14. Ink is carried via a flexible conduit 16 to a print head 18. A vibrating piezoelectric element 20 breaks the ink into drops 21 as they leave an orifice 22 in a nozzle 24. As the drops 21 exit the nozzle, they pass the charge electrode 25 where they receive an electric charge. The magnitude of the charge is set by charge amplifier 26 under control of microprocessor 10. The deflection electrodes 28, which are supplied with a high voltage, generate an electric field. The electric field acts on the charged drops, causing them to be deflected to a desired location on the substrate. Drops that are not projected onto the substrate are caught by a collector 32 for subsequent reuse. The voltage on the deflection electrodes 28 or the gain of the charge amplifier 26 may be adjusted by the microprocessor 10.

The present invention exploits the relationship between the measured parameters and the adjusted parameters for the purpose of maintaining constant character height. As noted previously, any of the three measured parameters may be used to control the value of either of the two adjusted parameters. For purposes of example, the following discussion concentrates on the use of flow rate to adjust deflection voltage. It will be readily apparent to one of ordinary skill in the art that this example can be easily modified to develop the relationships between any of the measured parameters and either adjusted parameter.

Figure 2A:
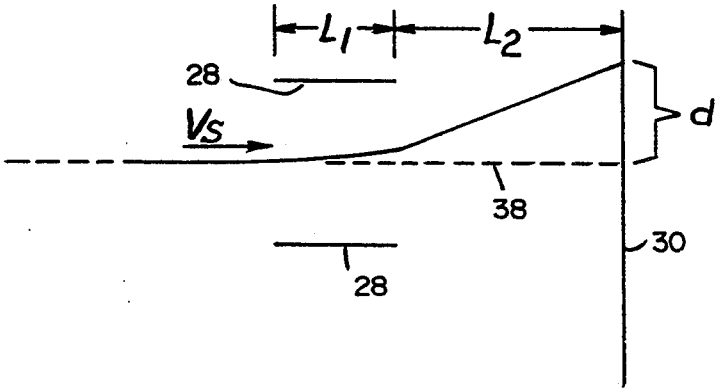
FIG. 2A is a diagram useful in explaining the relationship between the stream velocity or flight time of an ink drop and character height under simplifying assumptions.

FIG. 2A shows the flight path 34 of an ink drop as it passes through the electric field created by the deflection electrodes 28. The ink drops are deposited on a substrate 30, such as a sheet of paper. The flight path the ink drop would follow absent the influence of the deflection field is shown by dashed line 38. $V_s$ represents the stream velocity of the marking fluid. $V_s$ is directly proportional to the flow rate, and can, therefore, be calculated by the system microprocessor after measurement of the flow rate. The deflection distance d represents the deflection induced by the action of the deflection electrodes on a given drop of marking fluid. The distance d is comprised of two components: $d_1$, the deflection distance while the ink drop is traveling through the deflection field and $d_2$, the deflection distance after the drop exits the deflection field. Therefore, distance d is the sum of distances $d_1$ and $d_2$. Distance $L_1$ is the length of the deflection field and distance $L_2$ is the length from the end of the deflection field to the substrate 30. Similarly, the time the ink drop spends traveling through the deflection field is designated $T_1$ while the time spent traveling to the substrate 30 after exiting the deflection field is designated $T_2$. Flight time T is the sum of $T_1$ and $T_2$.

For simplicity and ease of understanding the present invention, it is useful to assume constant drop mass, charge, stream velocity and to ignore charge interactions between drops. Under these assumptions, the following relationships between the various parameters may be expressed:

$$d=(\tfrac{1}{2})aT_1^2+aT_1T_2 \quad [1]$$

Drop acceleration a is generally represented as follows:

$$a=\frac{qE}{m} \quad [2]$$

where E represents the magnitude of the electric field created by the deflection electrodes. The magnitude of the charge imparted to the ink drop by the charge amplifier 26 is designated q. The mass of the ink drop is designated m.

It should be apparent to one of ordinary skill in the art that the electric field magnitude E is proportional to the voltage across the deflection electrodes and will vary depending on the exact dimensions and spacing of the electrodes. For a given set of electrodes, this relationship can be easily computed.

The following equations express time spent by the ink drop traveling at velocity $V_s$ in the deflection field ($T_1$) and the time after the drop exits the deflection field until it impacts the substrate ($T_2$):

$$T_1=L_1/V_s \quad [3]$$

$$T_2=L_2/V_s \quad [4]$$

Substituting equations [3]and [4]into equation [1] yields the following equation for character height d:

$$d=(\tfrac{1}{2})(a)(L_1/V_s)^2+(a)(L_1L_2)/(V_s^2) \quad [5]$$

Simplifying further:

$$d=\frac{aL_1(L_1/2+L_2)}{V_s^2} \quad [6]$$

Finally, let:

$$K_1=L_1(L_1/2+L_2) \quad [7]$$

Thus:

$$d=(aK_1)/V_s^2 \quad [8]$$

As can be readily seen from Equation 8, the above relationship indicates that character height d is directly proportional to acceleration a induced on the ink drop, which is in turn, proportional to the voltage supplied to the deflection electrodes of the drop marker. Under the simplifying assumptions as stated above, the character height d also varies inversely with the square of stream velocity $V_s$. Therefore, uniform character height can be maintained as $V_s$ changes by determining $V_s$ and adjusting the deflection electrode voltage level to maintain the electric field strength so that acceleration a is adjusted proportionally to the square of $V_s$.

Rearranging [8]and assuming constant deflection d:

$$a=(d/K_1)(V_s)^2 \quad [9]$$

$$\text{since } a=(q/m)E=(q/m)\cdot HV/D_G \quad [10]$$

$$(q/m)\cdot HV/D_G=(d/K_1)(V_s)^2 \quad [11]$$

where HV is the deflection voltage and $D_G$ is the deflection electrode gap distance.

Then, $$HV=[(m/q)\cdot(D_G\cdot d)/K_1](V_s)^2 \quad [12]$$

Since all terms in the brackets are assumed constant, HV must vary in proportion to $(V_s)^2$ to maintain constant deflection, d.

$$\text{If } K_2=[(m/q)\cdot(D_G\cdot d)/K_1]\text{then } HV=K_2(V_s)^2 \quad [13]$$

represents the proper relationship between the deflection voltage and stream velocity.

In a preferred embodiment, the control system of the present invention exploits these relationships by determining the stream velocity $V_s$ and adjusting the voltage across the deflection electrodes to maintain constant character height.

Empirical test data indicates that character height actually varies to a greater extent than by the square of $V_s$. This is caused in part by the fact that the simplifying assumptions made for the foregoing analysis do not prevail in actual printer operation. For example, nozzle drive frequency remains constant even though $V_s$ changes over time. The result is that drop mass changes, altering the relationship between character height and stream velocity. Other contributing factors are variation in drop charge, mutual repulsion of charged drops in flight and aerodynamic effects on the flight of drops. The resulting relationship in an actual printer may be expressed as:

$$HV=K_2(V_s)^n \quad [14]$$

where n is a number between 2 and 3, for example 2.5.

These effects can be compensated by empirically measuring the relationship between the parameter being measured to control character height (for example, flow time, flow rate or flight time) and the parameter used to adjust character height (for example, deflection voltage or charge amplifier gain) for constant character height. FIG. 4 shows an example of empirical data relating the measured parameter, flow time, to the adjusted parameter, deflection voltage. Furthermore, as will be described hereinafter, a linear approximation of this relationship may be employed to set the value of the adjusted parameter over a realistic operating range.

It should be noted that the foregoing analysis allows uniformity of character height to be maintained regardless of variation in external operating conditions, such as temperature. It will be apparent that the relationship between flow rate $V_s$, flow time and total flight time $T_1+T_2$ is such that only one of these parameters need be known to allow determination of a relationship for constant character height that can be employed by the present invention (see equations [3]and [4]). Furthermore, the flight time between two fixed points within the print head is proportional to total flight time. Therefore, this flight time, which is more convenient to measure, is also suitable as the measured parameter.

If flight time is the measured parameter, $L_{FLT}$ is the distance over which flight time is measured and $T_{FLT}$ is the flight time over that distance, then:

$$V_s=L_{FLT}/T_{FLT}$$

Substituting this into equation [13]

$$HV=K_2(L_{FLT})_2/(T_{FLT})^2 \quad [15]$$

$$HV=[K_2\cdot(L_{FLT})_2](1/(T_{FLT})_2) \quad [16]$$

$$\text{then } HV=[K_3]\cdot 1/(T_{FLT})^2 \quad [17]$$

represents the proper relationship between HV and flight time, $T_{FLT}$, to maintain constant deflection under the simplifying assumptions stated earlier. Also, as stated earlier, the actual printer performance varies more strongly than the inverse to the 2nd power of $T_{FLT}$. The more general case is:

$$HV=[K_3]\cdot 1/(T_{FLT})^n, 2\leqq n\leqq 3. \quad [18]$$

If flow time is used instead of flight time, a different constant multiplier would be substituted for $K_3$ and flow time is substituted for flight time.

Thus, flow rate, flow time or flight time may be measured to practice the teachings of the present invention, depending on relative ease and/or expense of acquiring the information.

Finally, it will be appreciated that an analysis similar to the foregoing can be performed to demonstrate that the general teachings of the present invention may be employed to maintain constant character height by scaling the gain of the charge amplifier 26 to affect the charge q applied to the ink drops prior to their entry into the deflection field. Normally, a charging voltage, $V_q$, is applied to the charge tunnel to cause a charge, q to be applied to the ink drop. Then $q=G_q\cdot V_q$ where $G_q$ represents the transfer function from voltage to charge. If this multiplying factor $G_q$ is increased or decreased, that is, scaled up or down, so will subsequent charge values applied to subsequent ink drops.

Using a similar derivation as [9] through [13] above, $$a=(q/m)E=G_q(V_q\cdot E/m) \quad [19]$$

$$G_q=[m\cdot d/(V_q\cdot E\cdot K_1)](V_s)^2 \quad [20]$$

Since all terms in the brackets are assumed constant, the charge amplifier scaling factor, $G_q$, must vary proportional to $(V_s)^2$ to maintain constant deflector, d.

$$\text{If } K_4=[m\cdot d/(V_q\cdot E\cdot K_1)] \text{ then } G_q=K_4(V_s)^2 \quad [21]$$

FIG. 2B illustrates that total character height $d_{CH}$ is the difference between the deflection distance of the most deflected drop $d_H$ for a given character and the deflection of the least deflected drop $d_L$ that is part of the same character. The teachings of the present invention are ultimately employed to maintain $d_{CH}$ constant. It will be apparent to one having ordinary skill in the art that this goal is accomplished by controlling the deflection distance of each individual drop forming a character because the amount of deflection is proportional to the magnitude of drop charge and the voltage across the deflection electrodes.

Figure 3:
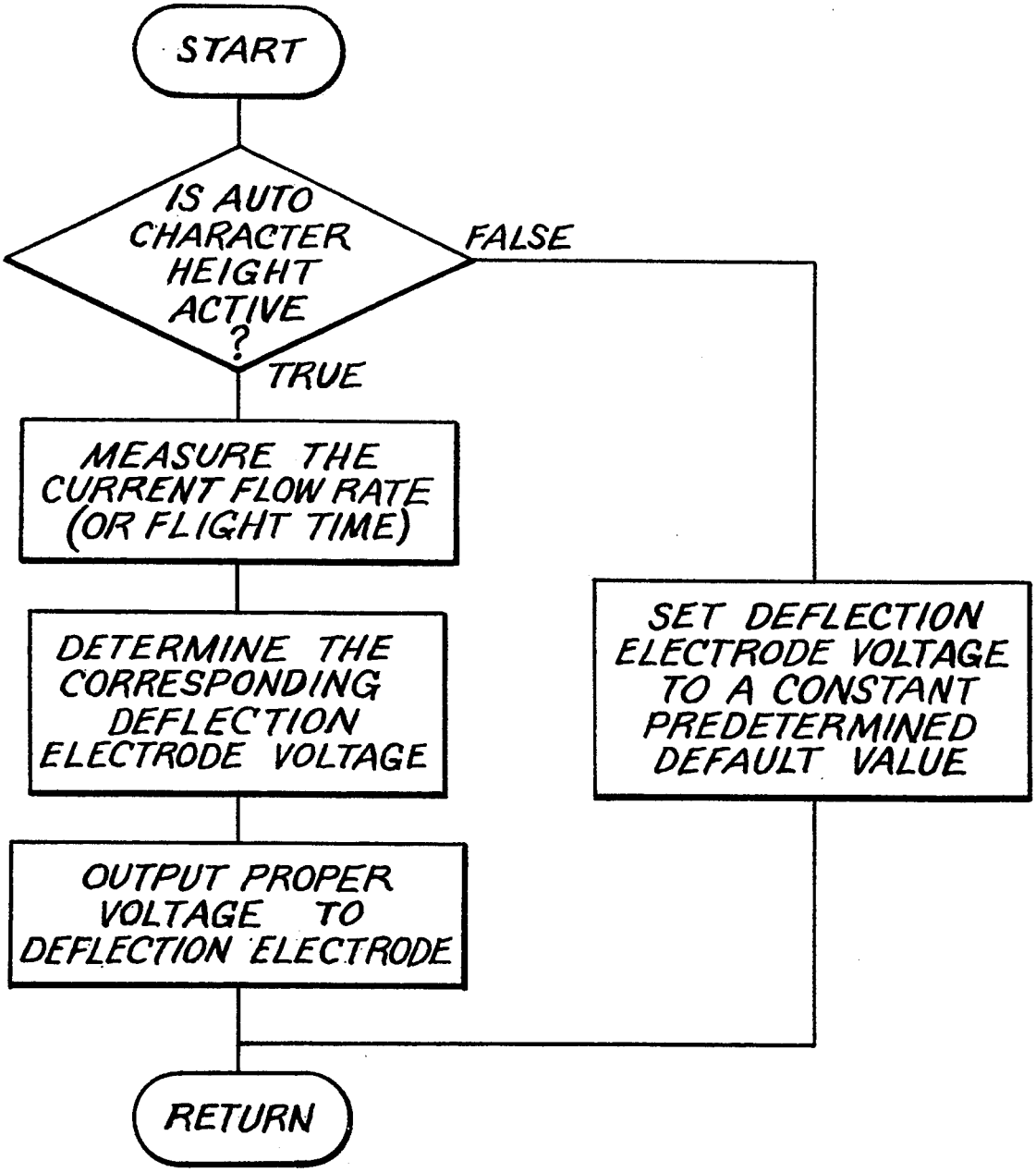
FIG. 3 is a software flow diagram useful for implementing the control function of the present invention.

FIG. 3 is a simplified flow diagram showing an algorithm suitable for use with a general purpose microprocessor for periodically determining one of the measured parameters previously described and using this information to control the adjusted parameter to maintain a desired character height. Assuming the automatic character height control feature is active, the user may select the desired character height for a given print job prior to operation of the drop marker. The algorithm can be executed periodically during printer operation or when the printer is idle. Experimental data demonstrates satisfactory results if the algorithm is executed at least every ten minutes during printer operation.

In operation, the system microprocessor determines one of the measured parameters. The teachings of the Arway or Stamer patents may be employed for measuring flow rate of marking fluid. Alternatively, the microprocessor may measure the flight time of ink drops by, for example, detecting the time taken for the drops to travel a known distance. Similarly, the microprocessor may measure flow time of marking fluid in chamber 12. As previously described, the calculations of deflection voltage will differ only slightly, depending on which measured parameter is determined.

Next, the microprocessor determines the value of the adjusted parameter necessary to maintain constant character height for the measured parameter. The microprocessor may determine the value of the adjusted parameter by employing one of three different methods.

In the first method, the microprocessor calculates the proper value of the adjusted parameter according to the mathematical relationships developed above.

In the second method, the microprocessor calculates the value of the adjusted parameter based on a mathematical approximation of empirically measured data relating one of the measured parameters to one of the adjusted parameters. As previously noted, acceptable uniformity of character height may be achieved by employing an approximation of the relationship between the measured parameter, rather than by calculating the corresponding value of the adjusted parameter. For example, the solid lines in FIG. 4 show a best fit curve approximation of the relationship between flow time and deflection voltage in the range of deflection voltages between 3 kilovolts and 6 kilovolts and flight times between sixty and seventy-five seconds.

The relationship between some combinations of measured parameters and adjusted parameters allows adjustment based on a linear approximation over certain ranges. The dashed lines in FIG. 4 show a linear approximation of the empirical relationship between flow time and deflection voltage. The slope of this line may be determined from mathematical analysis of the empirical data. After the slope has been determined, the microprocessor may be programmed to calculate the new deflection voltage value using linear approximation after measuring the prevailing flow time.

An example of an algorithm suitable for calculating the new deflection voltage consists of initial measurement of the deflection voltage. This value is designated $HV_{ref}$. Next, the initial flow time $T_{ref}$ is measured. The slope of the linear approximation of the relationship between flow time and deflection voltage, which has been determined previously from empirical data, is designated S. The actual flow time measured for a specific subsequent adjustment of the deflection voltage is designated $T_{actual}$. A short term average of a number of recent flow time measurements may be used for $T_{actual}$, depending on the desired accuracy in control of character height. $HV_{actual}$ represents the calculated value of the deflection voltage required to maintain constant character height for the flow time $T_{actual}$. Under these conditions, the microprocessor will calculate the new deflection voltage $HV_{actual}$ as follows:

$$HV_{actual}=HV_{ref}+S(T_{ref}-T_{actual}) \quad [22]$$

The calculated deflection voltage may be limited to minimum and maximum acceptable values in the event that the calculated value goes beyond the range over which the linear approximation is sufficiently accurate or goes beyond the range allowed for the head design.

In the third method, the microprocessor utilizes a look-up table stored in system memory that relates a given measured parameter to the corresponding adjusted parameter. As will be apparent to one of ordinary skill in the art, data for the look-up table may be obtained using either of the first two methods.

Finally, the microprocessor sets the adjusted parameter to the level determined by method one, method two or method three. As previously noted, the microprocessor may be programmed to determine the measured parameters as often as desired for a specific application. Thus, character height is automatically controlled based on the prevailing flow rate, flow time or flight time, but without regard to external factors, such as operating temperature or any physical characteristic of a specific type of marking fluid.

The present invention has been described with respect to certain embodiments and conditions, which are not meant to limit the invention. Those skilled in the art will understand that variations from the embodiments and conditions described herein may be made without departing from the invention as set forth in the appended claims.

What is claimed is:

1. In an ink jet printer including means for creating a stream of electrically conductive marking fluid and for breaking said stream into drops, means for imparting an electric charge on selected ones of said drops, a set of deflection electrodes for creating an electric field in flight path of said drops to alter the flight path thereof, said electric field being proportional to a deflection voltage present on said deflection electrodes, the improvement comprising:

a control system for maintaining drop deflection substantially constant during normal printing operation of said printer, regardless of changes in the operating environment, said system including:

a) means for periodically determining the velocity of said stream during said normal operation of said printer;

b) means for adjusting said deflection voltage responsive to changes in stream velocity to maintain drop deflection substantially constant.

2. The printer of claim 1 wherein said means for adjusting includes a processor for altering said deflection voltage according to an approximation of the relationship:

$$HV=K_2(V_s)^2$$

where HV represents the deflection voltage applied to the deflection electrodes, $K_2$ represents a constant for a given drop marking device and $V_s$ represents the velocity of said stream.

3. The printer of claim 1 wherein said means for adjusting includes a processor for altering said voltage according to a linear approximation of empirically determined data relating said stream velocity to said voltage.

4. The printer of claim 1 wherein said means for adjusting includes memory means having a look-up table for relating said deflection voltage level to a corresponding stream velocity, said deflection voltage being periodically adjusted responsive to said determination of said stream velocity according to the corresponding deflection voltage value in the look-up table so that said drop deflection is uniformly maintained.

5. In an ink jet printer including means for creating a stream of electrically conductive marking fluid and for breaking said stream into drops, charge amplifier means for imparting an electric charge on selected ones of said drops, a set of deflection electrodes for creating an electric field in the flight path of said drops to alter the flight path thereof, said electric field being proportional to a deflection voltage present on said deflection electrodes, the improvement comprising:

a control system for maintaining drop deflection substantially constant during normal printing operation of said printer, regardless of changes in the operating environment, said system including:

a) means for periodically determining the velocity of said stream during said normal operation of said printer;

b) means for scaling the electric charge applied to said drops responsive to changes in stream velocity to maintain drop deflection substantially constant.

6. The printer of claim 5 wherein said means for scaling includes a processor for altering charge amplifier gain according to an approximation of the relationship:

$$G_q = K_4(V_s)^2$$

where $G_q$ represents charge amplifier gain $K_4$ represents a constant for a given drop marking device, including at least the value of said deflection voltage and the mass of each said drop, and $V_s$ represents the velocity of said stream.

7. The printer of claim 5 wherein said means for scaling includes a processor for altering charge amplifier gain according to a linear approximation of empirically determined data relating stream velocity to charge amplifier gain.

8. The printer of claim 5 wherein said means for scaling includes a memory means having a look-up table for relating charge amplifier gain to a corresponding stream velocity, said gain being periodically adjusted responsive to periodic determinations of said stream velocity.

9. In an ink jet printer including means for creating a stream of electrically conductive marking fluid and for breaking said stream into drops, means for imparting an electric charge on selected ones of said drops, a set of deflection electrodes for creating an electric field in the flight path of said drops to alter the flight path thereof, said electric field being proportional to a deflection voltage present on said deflection electrodes, the improvement comprising:

a control system for maintaining drop deflection substantially constant during normal printing operation of said printer, regardless of changes in the operating environment, said system including:

a) means for periodically determining the flight time of said drops over a known distance during said normal operation of said printer;

b) means for adjusting said deflection voltage responsive to changes in flight time to maintain drop deflection substantially constant.

10. The printer of claim 9 wherein said means for adjusting includes a processor for altering said deflection voltage according to an approximation of the relationship:

$$HV = [K_3] \cdot 1/(T_{FLT})^2$$

where HV represents the deflection voltage applied to the deflection electrodes, $K_3$ represents a constant for a given drop marking device and $T_{FLT}$ represents flight time of said drops over a known distance.

11. The printer of claim 9 wherein said means for adjusting includes a processor for altering said voltage according to a linear approximation of empirically determined data relating said flight time to said voltage.

12. The printer system of claim 9 wherein said means for adjusting includes a memory means having a look-up table for relating said deflection voltage to a corresponding flight time, said deflection voltage being periodically adjusted responsive to said determination of said flight time according to the corresponding voltage value in the look-up table so that said character height is uniformly maintained.

13. In an ink jet printer including means for creating a stream of electrically conductive marking fluid and for breaking said stream into drops, charge amplifier means for imparting an electric charge on selected ones of said drops, a set of deflection electrodes for creating an electric field in the flight path of said drops to alter the flight path thereof, said electric field being proportional to a deflection voltage present on said deflection electrodes, the improvement comprising:

a control system for maintaining drop deflection substantially constant during normal printing operation of said printer, regardless of changes in the operating environment, said system including:

a) means for periodically determining the flight time said drops over a known distance during said normal operation of said printer;

b) means for scaling the electric charge applied to said drops responsive to changes in flight time to maintain drop deflection substantially constant.

14. The printer of claim 13 wherein said means for scaling includes a processor for altering charge amplifier gain according to an approximation of the relationship:

$$G_q = [K_5] \cdot 1/(T_{FLT})_2$$

where $G_q$ represents the charge amplifier gain or scale factor, $K_5$ represents a constant for a given drop marking device and $T_{FLT}$ represents flight time of said drops over a known distance.

15. The printer of claim 13 wherein said means for scaling includes a processor for altering charge amplifier gain according to a linear approximation of empirically determined data relating said flight time to said gain.

16. The printer of claim 13 wherein said means for scaling includes a memory means having a look-up table for relating charge amplifier gain to a corresponding flight time, said gain being periodically adjusted responsive to said determination of said flight time according to the corresponding gain value in the look-up table so that said deflection is uniformly maintained.

17. In an ink jet printer including means for creating a stream of electrically conductive marking fluid and for breaking said stream into drops, means for imparting an electric charge on selected ones of said drops, a set of deflection electrodes for creating an electric field in the flight path of said drops to alter the flight path thereof, said electric field being proportional to a deflection voltage present on said deflection electrodes, the improvement comprising:

a control system for maintaining drop deflection substantially constant during normal printing operation of said printer, regardless of changes in the operating environment, said system including:

a) means for periodically determining flow time of said stream of marking fluid between two known points within said system during said normal operation of said printer;

b) means for adjusting said deflection voltage responsive to changes in flow time to maintain drop deflection substantially constant.

18. The printer of claim 17 wherein said means for adjusting includes a processor for altering said voltage according to a linear approximation of empirically determined data relating said flow time to said voltage.

19. The system of claim 17 wherein said means for adjusting includes memory means having a look-up table for relating said deflection voltage level to a corresponding flow time, said deflection voltage being periodically adjusted responsive to said determination of said flow time according to the corresponding deflection voltage value in the look-up table so that drop deflection is uniformly maintained.

20. In an ink jet printer including means for creating a stream of electrically conductive marking fluid and for breaking said stream into drops, charge amplifier means for imparting an electric charge on selected ones of said drops, a set of deflection electrodes for creating an electric field in the flight path of said drops to alter the flight path thereof, said electric field being proportional to a deflection voltage present on said deflection electrodes, the improvement comprising:

a control system for maintaining drop deflection substantially constant during normal printing operation of said printer, regardless of changes in the operating environment, said system including:

a) means for periodically determining flow time of said stream of marking fluid between two known points within said system during said normal operation of said printer;

b) means for scaling the electric charge applied to said drops responsive to changes in flow time to maintain drop deflection substantially constant.

21. The system of claim 20 wherein said means for scaling includes a processor for altering charge amplifier gain according to a linear approximation of empirically determined data relating said flow time to said gain.

22. The system of claim 20 wherein said means for scaling includes a memory means having a look-up table for relating charge amplifier gain to a corresponding flow time, said gain being periodically adjusted responsive to said determination of said flow time according to the corresponding gain in the look-up table so that said drop deflection is uniformly maintained.

* * * * *